US008251498B2

(12) United States Patent
Shimizu et al.

(10) Patent No.: US 8,251,498 B2
(45) Date of Patent: Aug. 28, 2012

(54) PROCESSING LIQUID APPLYING APPARATUS AND IMAGE-FORMING APPARATUS

(75) Inventors: Yoichiro Shimizu, Kasugai (JP); Masahiro Nishizaki, Iwakura (JP); Yoshitsugu Morita, Nagoya (JP); Tomoyuki Kubo, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 375 days.

(21) Appl. No.: 12/712,709

(22) Filed: Feb. 25, 2010

(65) Prior Publication Data

US 2010/0220160 A1 Sep. 2, 2010

(30) Foreign Application Priority Data

Feb. 27, 2009 (JP) ..... 2009-045832

(51) Int. Cl.
*B41J 2/175* (2006.01)

(52) U.S. Cl. ..... 347/85; 347/5; 399/357; 399/239; 118/258

(58) Field of Classification Search ..... 347/85, 347/5; 118/258; 399/343, 357, 239
See application file for complete search history.

(56) References Cited

U.S. PATENT DOCUMENTS

| | | | | |
|---|---|---|---|---|
| 4,538,541 | A | 9/1985 | Zimmer | |
| 5,477,313 | A * | 12/1995 | Kuramochi et al. | 399/239 |
| 5,561,264 | A * | 10/1996 | Iino et al. | 399/240 |
| 6,236,825 | B1 * | 5/2001 | Takeuchi | 399/237 |
| 6,347,212 | B1 * | 2/2002 | Kosugi et al. | 399/348 |
| 2002/0197083 | A1 | 12/2002 | Yoshino et al. | |

FOREIGN PATENT DOCUMENTS

| | | |
|---|---|---|
| JP | 58177179 | 10/1983 |
| JP | 4-044847 | 2/1992 |
| JP | 7032587 | 2/1995 |
| JP | 11314352 | 11/1999 |
| JP | 2000-334928 | 12/2000 |
| JP | 2002-357958 | 12/2002 |
| JP | 2003-307937 | 10/2003 |
| JP | 2005-338734 | 10/2003 |
| JP | 2006-178224 | 7/2006 |
| JP | 2006-346534 | 12/2006 |
| JP | 2007-301814 | 11/2007 |

* cited by examiner

*Primary Examiner* — Ellen Kim
(74) *Attorney, Agent, or Firm* — Frommer Lawrence & Haug LLP

(57) ABSTRACT

A processing liquid applying apparatus includes a processing liquid transfer roller which transfers a processing liquid to a transfer medium while rotating in a predetermined direction; a processing liquid applying section which applies the processing liquid to a surface of the processing liquid transfer roller; a downstream wall which is positioned on a downstream side in a rotating direction of the processing liquid transfer roller with respect to the processing liquid applying section; and a downstream wall moving mechanism which moves the downstream wall between a downstream wall first position at which the downstream wall is positioned when the processing liquid is transferred to the transfer medium and a downstream wall second position at which the downstream wall is positioned when the surface of the processing liquid transfer roller is washed with the processing liquid.

13 Claims, 9 Drawing Sheets

PROCESSING LIQUID APPLYING APPARATUS AND IMAGE-FORMING APPARATUS

CROSS REFERENCE TO RELATED APPLICATION

The present application claims priority from Japanese Patent Application No. 2009-045832, filed on Feb. 27, 2009, the disclosure of which is incorporated herein by reference in its entirety.

BACKGROUND OF THE INVENTION

1. Field of the Invention

The present invention relates to a processing liquid applying apparatus which applies a processing liquid to a surface of a processing liquid transfer roller and transfers the processing liquid to a transfer medium (for example, printing paper and recording sheet), and an image-forming apparatus provided with the processing liquid applying apparatus.

2. Description of the Related Art

For example, in an image-forming apparatus (for example, printer and facsimile) based on the "ink-jet system", the inks, which are discharged from the nozzles, are adhered or deposited onto the surface of the printing paper. In this situation, the inks are not preferably deposited onto the printing paper depending on the type of the inks or the printing paper, and the image is blurred and/or the color development is deteriorated in some cases. Accordingly, in the case of a conventional technique, as disclosed in Japanese Patent Application Laid-open No. 2006-346534 (FIG. 12), the blurring of the image is avoided, and the deterioration of the color development performance is avoided by previously applying a processing liquid to the surface of the printing paper.

A liquid applying apparatus disclosed in Japanese Patent Application Laid-open No. 2006-346534 includes an applying roller which applies a processing liquid to a sheet member while rotating in a predetermined direction, and a liquid applying section which applies the processing liquid to the surface of the applying roller. The liquid applying section includes a space-forming member which forms a hermetically closed space with respect to the applying roller, an annular abutting member which seals the circumferential edge portion of the hermetically closed space, and a pressing member (spring) which supports the space-forming member and the abutting member and which presses them toward the applying roller. The processing liquid is supplied into the hermetically closed space, the applying roller is rotated, and thus the processing liquid is applied to the surface of the applying roller which constitutes a part of the hermetically closed space.

According to the conventional technique described above, a mechanism, which applies the processing liquid to the surface of the applying roller, can be easily constructed. However, the space-forming member and the abutting member are merely supported by the pressing member (spring). Therefore, the spacing distance between the abutting member and the applying roller cannot be maintained to be constant and/or the spacing distance cannot be appropriately changed. It is impossible to optionally and preferably adjust the applying amount of the processing liquid with respect to the applying roller.

For example, when the applying amount of the processing liquid is excessively increased in the "transfer mode" in which the processing liquid is transferred from the applying roller to the sheet member, it is feared that a long period of time may be required to dry the processing liquid transferred to the sheet member and/or the processing liquid, which remains on the surface of the applying roller, may inhibit the next transfer process. Therefore, it is necessary that the applying amount of the processing liquid should be stabilized to an appropriate amount. In the case of the conventional technique described above, the abutting member is moved in the tangential direction of the applying roller in accordance with the rotation of the applying roller, and the spacing distance, which is provided between the applying roller and the portion of the abutting member positioned on the downstream side in the direction of rotation of the applying roller, is undesirably widened. Therefore, a tendency arises such that the applying amount of the processing liquid is not only stabilized, but the applying amount is also increased undesirably. On the other hand, in the "cleaning mode" in which the applying roller is cleaned, it is desirable that the applying amount of the processing liquid applied to the applying roller is "relatively large" in order to wash out the foreign matter (paper dust or the like) adhered to the applying roller. In the case of the conventional technique described above, it is impossible to appropriately change the spacing distance between the abutting member and the applying roller. Therefore, it is impossible to intentionally increase the applying amount of the processing liquid in the "cleaning mode", and it is impossible to obtain any sufficient cleaning effect.

SUMMARY OF THE INVENTION

The present invention has been made in order to solve the problem as described above, an object of which is to provide a processing liquid applying apparatus and an image-forming apparatus provided with the processing liquid applying apparatus which make it possible to preferably adjust the applying amount of a processing liquid with respect to a processing liquid transfer roller in the "transfer mode" and the "cleaning mode" respectively.

According to a first aspect of the present invention, there is provided a processing liquid applying apparatus which applies a processing liquid to a transfer medium, including: a processing liquid transfer roller which transfers the processing liquid to the transfer medium while rotating in a predetermined direction; a processing liquid applying section which makes a contact with a surface of the processing liquid transfer roller to apply the processing liquid to the surface of the processing liquid transfer roller; a downstream wall which is positioned on a downstream side in a rotating direction of the processing liquid transfer roller with respect to a contact point at which the surface of the processing liquid transfer roller makes a contact with the processing liquid in the processing liquid applying section; and a downstream wall moving mechanism which moves the downstream wall, in a tangential direction at the contact point of the processing liquid applying section and the processing liquid transfer roller, between a downstream wall first position at which the downstream wall is positioned while the processing liquid transfer roller is transferring the processing liquid to the transfer medium and a downstream wall second position at which the downstream wall is positioned while the surface of the processing liquid transfer roller is being washed with the processing liquid, wherein a distance between the downstream wall positioned at the downstream wall second position and the processing liquid transfer roller, is greater than a distance between the downstream wall positioned at the downstream wall first position and the processing liquid transfer roller.

In this arrangement, the distance between the downstream wall and the processing liquid transfer roller, which is provided when the downstream wall is positioned at the downstream wall second position, is greater than that provided when the downstream wall is positioned at the downstream wall first position. Therefore, the applying amount of the processing liquid to be applied to the surface of the processing liquid transfer roller is increased when the downstream wall is positioned at the downstream wall second position as compared with when the downstream wall is positioned at the downstream wall first position.

The present teaching is constructed as explained above. The applying amount of the processing liquid, with which the processing liquid transfer roller is applied, can be preferably adjusted in each of the "transfer mode" and the "cleaning mode". In other words, in the "transfer mode" in which the processing liquid is transferred to the transfer medium, the applying amount of the processing liquid with respect to the processing liquid transfer roller can be adjusted to be "relatively small", for example, in order to quicken the drying of the processing liquid transferred to the transfer medium. On the other hand, in the "cleaning mode" in which the surface of the processing liquid transfer roller is washed, the applying amount of the processing liquid with respect to the processing liquid transfer roller can be adjusted to be "relatively large" in order to wash out the foreign matter (for example, paper dust or paper powder) adhered to the processing liquid transfer roller.

DESCRIPTION OF THE PREFERRED EMBODIMENTS

Figure 1:
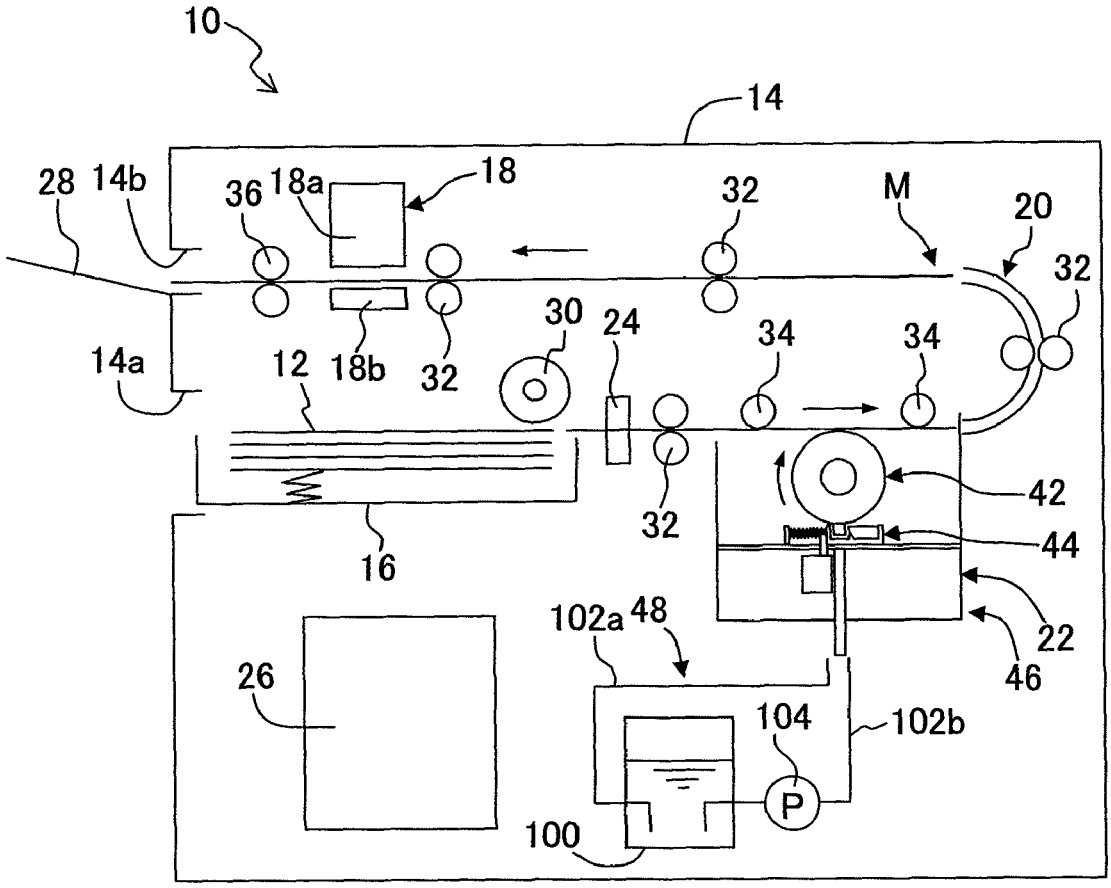
FIG. 1 conceptually shows an arrangement of an image-forming apparatus according to a first embodiment.

An "image-forming apparatus" according to a preferred embodiment of the present invention will be explained below with reference to the drawings. A "processing liquid applying apparatus" according to a preferred embodiment of the present invention will be referred to as a constitutive part of the "image-forming apparatus" in the description of the "image-forming apparatus".

First Embodiment

Overall Arrangement of Image-Forming Apparatus

An image-forming apparatus 10 includes a casing 14, a paper feed cassette 16, a liquid discharge apparatus 18, a transport apparatus 20, a processing liquid applying apparatus 22, a detecting unit 24, and a control unit 26, and a processing liquid R (FIG. 4) is applied to the printing paper 12 as the "transfer medium" or the medium subjected to the transfer, and then the inks as the "liquids" are discharged to the surface of the printing paper 12 to form an image.

The casing 14 is a box-shaped member which accommodates the constitutive parts as described above. An opening 14*a* through which the paper feed cassette 16 is taken in and out and a printing paper discharge port 14*b* through which the printing paper 12 is discharged are formed on the side surface of the casing 14. A paper discharge tray 28, which receives the printing paper 12 discharged from the printing paper discharge port 14*b*, is attached under or below the printing paper discharge port 14*b*.

The paper feed cassette 16 is a container or vessel which collectively accommodates a plurality of sheets of the printing paper 12. A pickup roller 30 for taking out the printing paper 12 is arranged over or above the paper feed cassette 16.

The liquid discharge apparatus 18 has an ink discharge head 18*a* based on the "ink-jet system" having a plurality of discharge nozzles. A platen 18*b*, which supports the printing paper 12, is arranged at a position opposed to the plurality of discharge nozzles. The ink discharge head 18*a* has a driving unit (for example, an actuator) which applies the discharge pressure to the ink based on the driving signal given from the control unit 26. The ink, to which the discharge pressure is applied, is discharged from the nozzles to the printing paper 12. The recording system of the liquid discharge apparatus 18 is not limited to the "ink-jet system". The type of the ink is not specifically limited as well. However, the "ink-jet system" is adopted in this embodiment. Therefore, in order to avoid the nozzle clog-up caused by the drying of the ink, the ink, which is obtained by mixing a water-soluble high boiling point solvent (for example, glycol) and a soluble color material with water as the main component, is used. Therefore, the fixation performance of the ink with respect to the printing paper 12 is not sufficient. In the processing liquid applying apparatus 22 described later on, a processing liquid R, which is capable of enhancing the fixing of the ink, is applied to the printing paper 12.

The transport apparatus 20 includes transport rollers 32 which feed the printing paper 12 taken out by the pickup roller 30 to the liquid discharge apparatus 18 via the detecting unit 24 and the processing liquid applying apparatus 22, holding rollers 34 which hold the printing paper 12 fed to the processing liquid applying apparatus 22, and paper discharge rollers 36 which discharge the printing paper 12 formed with the image by the liquid discharge apparatus 18 from the printing paper discharge port 14*b* to a paper discharge tray 28. In this embodiment, a substantially C-shaped transport route M is constructed by the transport apparatus 20.

The processing liquid applying apparatus 22 applies the processing liquid R (FIG. 4) to the printing paper 12 on the upstream side in the transport direction of the printing paper 12 with respect to the liquid discharge apparatus 18. The present invention has the feature of the arrangement of the processing liquid applying apparatus 22. Therefore, the concerning arrangement will be explained in detail later on. In this embodiment, the processing liquid applying apparatus 22 is arranged in the middle of the transport route M for transporting the printing paper 12. Therefore, in the description provided later on, the direction, in which the printing paper 12 is transported, is referred to as "transport direction X", and the direction, which is perpendicular to the "transport direction X" is referred to as "printing paper widthwise direction Y".

The detecting unit 24 is arranged on the upstream side in the transport direction of the printing paper 12 with respect to the processing liquid applying apparatus 22. The detecting unit 24 detects the type (for example, thickness, surface smoothness, and hardness) of the printing paper 12. The detection result of the detecting unit 24 is fed to the control unit 26.

The control unit 26 include a central processing unit (CPU) which executes various types of calculation processes, and storage devices (ROM, RAM) which store various types of data and programs. The control unit 26 controls the operations of, for example, the liquid discharge apparatus 18, the transport apparatus 20, the processing liquid applying apparatus 22, and a stopper driving apparatus 96 (FIG. 4) described later on. Specified control operation of the control unit 26 will be explained together with the explanation of the operation of the image-forming apparatus 10 described later on.

Overall Arrangement of Processing Liquid Applying Apparatus

In this embodiment, the ink, which contains the water-soluble high boiling point solvent (for example, glycol) and the soluble color material, is used as described above. Therefore, it is feared that the high quality is not obtained due to, for example, the blurring of the ink, when the ink is discharged to the unprocessed or untreated printing paper 12. Accordingly, in this embodiment, the processing liquid R, which makes it possible to enhance the fixation performance of the ink, is previously applied to the printing paper 12 by using the processing liquid applying apparatus 22. The type of the processing liquid R can be appropriately changed depending on, for example, the type of the printing paper 12, the type of the ink, or the purpose of the processing. For example, a liquid containing multivalent metal salt, a cationic surfactant, or a cationic polymer material, which agglutinate or react the color material contained in the ink and which are capable of increasing density or waterproofness of the ink as well as enhancing fixing of the ink, are usable as the processing liquid R. Further, the processing liquid R may contain fine particles such as silica particles, alumina particles, or resin emulsion. In order to perform high-speed printing, a liquid containing organic solvent or surfactant which enhance permeability of the ink is usable as the processing liquid. A liquid to keep the printing paper from curling (especially, a curl occurring immediately after the printing) may be used as the processing liquid R. In order to improve the brightness or whiteness of the printing paper 12, a "liquid containing a fluorescent whitener" may be used as the processing liquid R.

As shown in FIG. 1, the processing liquid applying apparatus 22 includes a processing liquid transfer roller 42 which transfers the processing liquid R (FIG. 4) to the printing paper 12 as the "transfer medium" while rotating in the predetermined direction, an applying member 44 which applies the processing liquid R to the surface of the processing liquid transfer roller 42, a support member 46 which supports the processing liquid transfer roller 42 and the applying member 44, and a processing liquid supply apparatus 48 which supplies the processing liquid R to the applying member 44.

Arrangement of Processing Liquid Transfer Roller

Figure 3:
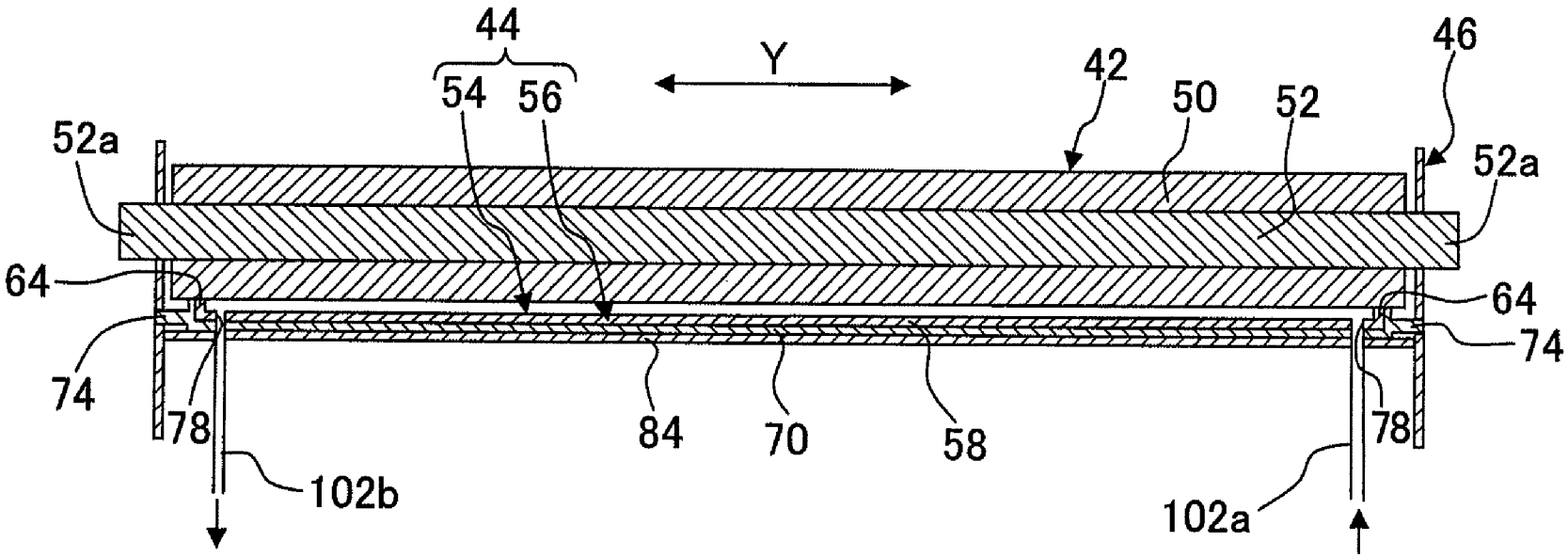
FIG. 3 shows a sectional view taken along a line shown in FIG. 2.
Figure 4:
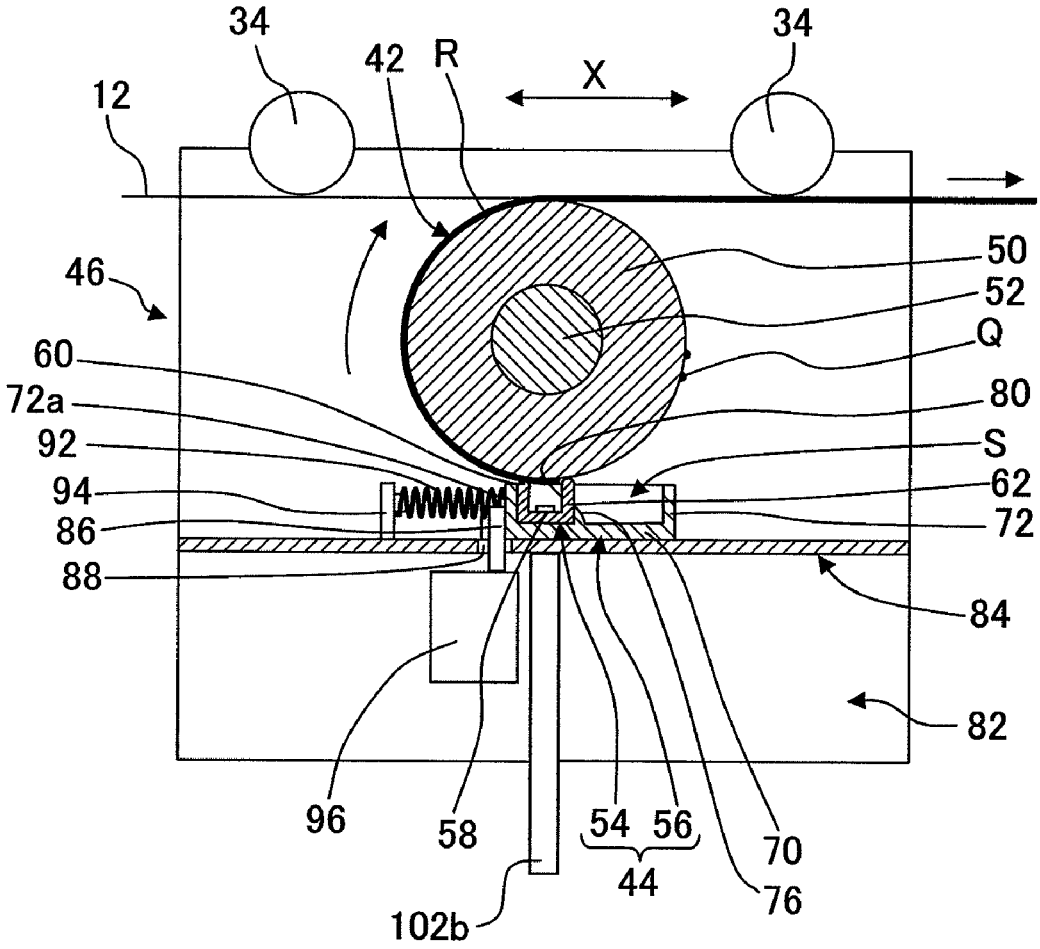
FIG. 4 shows a sectional view taken along a line IV-IV shown in FIG. 2.

As shown in FIGS. 3 and 4, the processing liquid transfer roller 42 has a roller body 50 which has the surface to be coated with the processing liquid R (FIG. 4), and a core member 52 which is arranged at the central portion of the roller body 50. Both end portions of the core member 52 in the longitudinal direction protrude from both end portions of the roller body 50 in the longitudinal direction. The roller body 50 is a substantially columnar member composed of a material (for example, epichlorohydrin rubber) which has a high affinity for the processing liquid R and which has a low affinity for the foreign matter Q (FIG. 4) such as the paper dust or the like. The length of the roller body 50 is designed to be sufficiently longer than the width of the printing paper 12 so that the processing liquid R can be transferred to the entire surface of the printing paper 12. The core member 52 is a substantially columnar member composed of a high strength material (for example, stainless steel) which is capable of reinforcing the roller body 50. The length of the core member 52 is designed to be sufficiently longer than the length of the roller body 50 so that a rotary shaft 52*a* can be constructed at each of the both ends of the roller body 50. The processing liquid transfer roller 42 is arranged so that the processing liquid transfer roller 42 extends in the printing paper widthwise direction Y and the processing liquid transfer roller 42 is brought in contact with the surface of the printing paper 12 between the two holding rollers 34 in the transport route M.

A rotary driving unit (not shown), which includes a motor and a gear unit, is connected to the rotary shaft 52*a* of the core member 52 disposed on one side. The direction of rotation of the processing liquid transfer roller 42 (hereinafter simply referred to as "rotating direction"), which is brought about by the rotary driving unit, is not specifically limited. However, in this embodiment, as shown in FIG. 4, the rotating direction is designed so that the processing liquid R can be transferred to the printing paper 12 from the upstream side in the transport direction X. In other words, the applying member 44 described later on applies the processing liquid R to the lowermost portion of the processing liquid transfer roller 42 in the vertical direction. Starting from this state, the processing liquid transfer roller 42 is rotated by 180 degrees in the rotating direction, and thus the portion, to which the processing liquid R has been applied, arrives at the uppermost position of the processing liquid transfer roller 42 in the vertical direction. The processing liquid R is transferred to the printing paper 12 transported in the transport direction X. After the processing liquid R is transferred to the printing paper 12, the processing liquid transfer roller 42 is further rotated by 180 degrees in the rotating direction. Accordingly, the processing liquid R is applied to the concerning portion by the applying member 44 again. In this way, the processing liquid transfer roller 42 repeats the rotation in the rotating direction. Accordingly, the application of the processing liquid R to the processing liquid transfer roller 42 and the transfer of the processing liquid R from the processing liquid transfer roller 42 to the printing paper 12 are continuously performed. In the following description, the "upstream side in the rotating direction" refers to the side on which the surface of the processing liquid transfer roller 42 exists before the processing liquid R is applied, and the "downstream side in the rotating direction" refers to the side on which the surface of the processing liquid transfer roller 42 exists after the processing liquid R is applied, based on the lowermost position of the processing liquid transfer roller 42 in the vertical direction.

Arrangement of Applying Member

Figure 5:
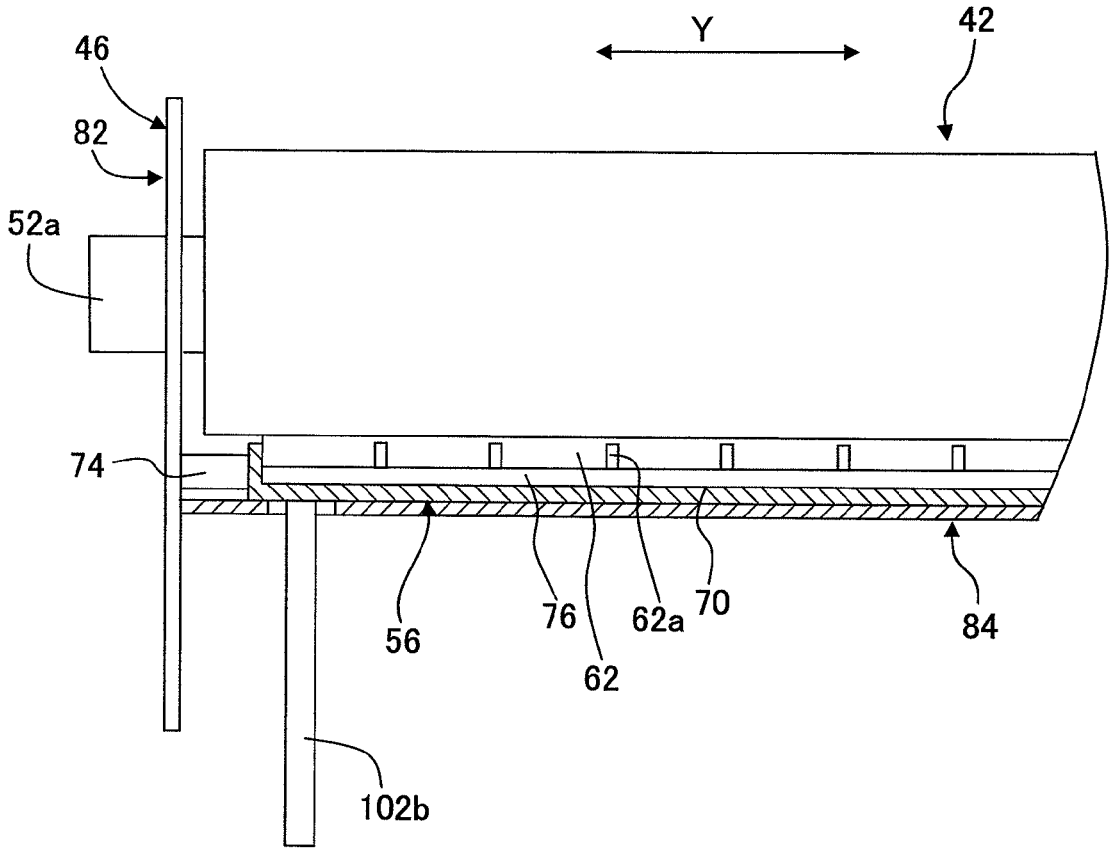
FIG. 5 shows a partial magnified sectional view illustrating the arrangement of the processing liquid applying apparatus according to the first embodiment.
Figure 6:
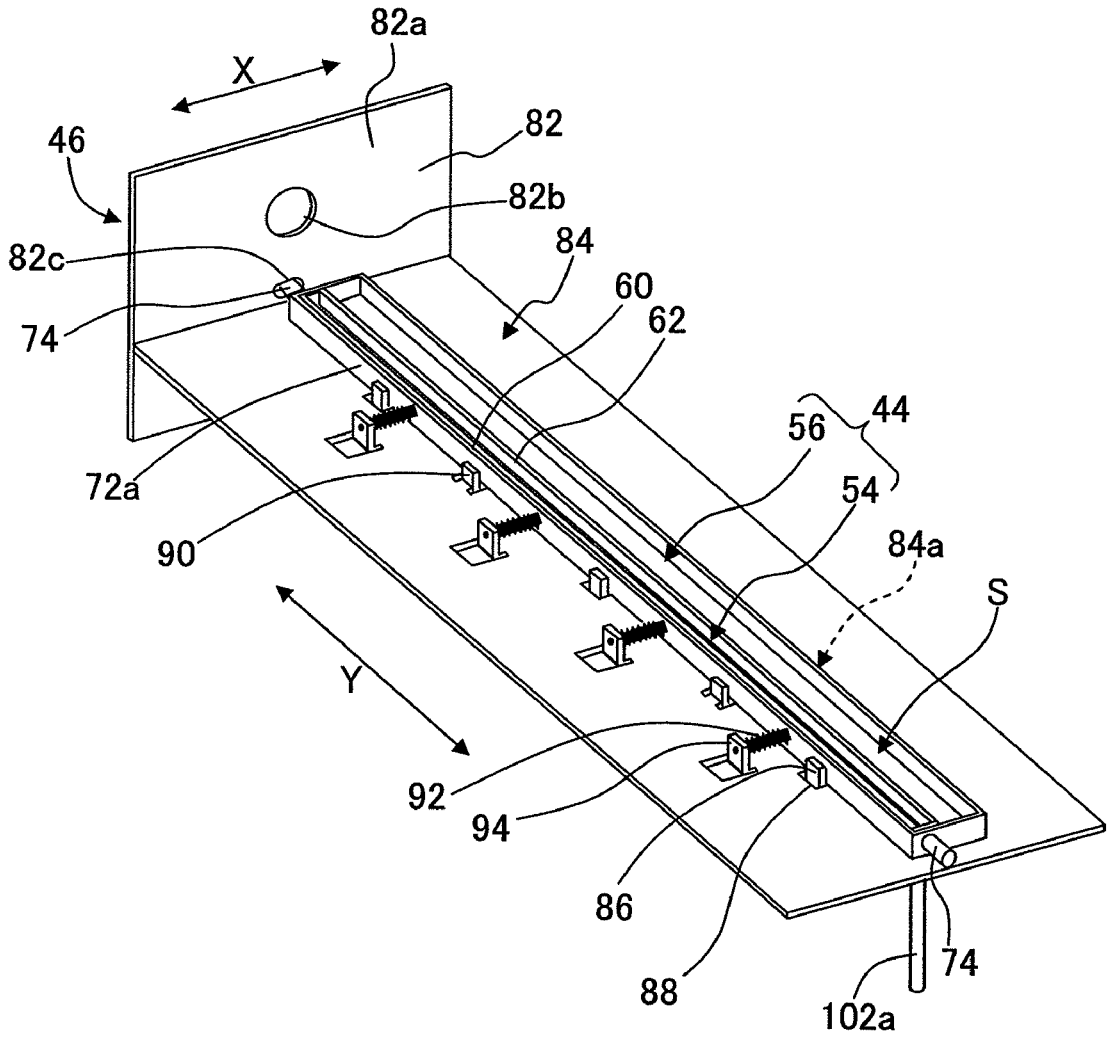
FIG. 6 shows a perspective view illustrating the arrangement of a part of the processing liquid applying apparatus according to the first embodiment.

As shown in FIGS. 4, 5, and 6, the applying member 44 has a processing liquid accommodating cap 54 which accommodates the processing liquid R (FIG. 4), and a cap holder 56 which holds the processing liquid accommodating cap 54.

The processing liquid accommodating cap 54 is a groove-shaped member which has an opening 80 disposed on the upper surface and which applies the processing liquid R to the surface of the processing liquid transfer roller 42 under or below the processing liquid transfer roller 42. As shown in FIGS. 3 and 4, the processing liquid accommodating cap 54 includes a plate-shaped bottom plate section 58 which is substantially rectangular as viewed in a plan view and which extends in the printing paper widthwise direction Y, a downstream wall 60 which is formed to protrude upwardly from the end edge disposed on the downstream side in the rotating direction on the upper surface of the bottom plate section 58, an upstream wall 62 which is formed to protrude upwardly from the end edge disposed on the upstream side in the rotating direction on the upper surface of the bottom plate section 58, and side walls 64 (FIG. 3) which are formed to protrude upwardly from the both end edges in the printing paper widthwise direction Y on the upper surface of the bottom plate section 58. As described later on, the downstream wall 60 functions as the "applying amount-adjusting member" to adjust the applying amount of the processing liquid R with respect to the processing liquid transfer roller 42, and the upstream wall 62 functions as the "cleaning member" which scrapes the foreign matter Q and the remaining processing liquid R off the surface of the processing liquid transfer roller 42. The frictional force, which is generated between the upstream wall 62 and the processing liquid transfer roller 42, is designed to be greater than the frictional force which is generated between the processing liquid applying roller 42 and the foreign matter Q. Accordingly, the foreign matter Q, which is adhered to the surface of the processing liquid transfer roller 42, can be effectively scraped off by the upstream wall 62 which functions as the "cleaning member".

As shown in FIG. 5, grooves 62*a*, which guide the processing liquid R and the foreign matter Q scraped off from the surface of the processing liquid transfer roller 42 by means of the upstream wall 62 (FIG. 4) as the "cleaning member" to the processing liquid recovery section S as described later on, are formed on the surface (i.e., the outer side surface) positioned on the upstream side in the rotating direction in relation to the upstream wall 62. Further, the water-attracting treatment is applied thereto in order to easily guide the processing liquid R and the foreign matter Q to the processing liquid recovery section S. The material of the processing liquid accommodating cap 54 is not specifically limited. However, in this embodiment, an elastic material, which includes, for example, rubber or elastomer, is used in order to prevent the surface of the processing liquid transfer roller 42 from being scratched or damaged.

The cap holder 56 is a container or vessel which holds the processing liquid accommodating cap 54 under or below the processing liquid transfer roller 42 and which recovers the processing liquid R and the foreign matter Q scraped off from the processing liquid transfer roller 42. As shown in FIGS. 3 and 4, the cap holder 56 has a plate-shaped bottom plate section 70 which is substantially rectangular as viewed in a plan view and which extends in the printing paper widthwise direction Y, and a circumferential wall 72 which is formed to protrude upwardly from the circumferential edge portion of the upper surface of the bottom plate section 70. The outer side surface of the circumferential wall 72, which is disposed on the downstream side in the rotating direction, is a fastening surface 72*a* to be fastened by transfer mode stoppers 86 or cleaning mode stoppers 90 as described later on. Projections 74, which regulate the movement of the cap holder 56 in the tangential direction of the processing liquid transfer roller 42 in accordance with the rotation of the processing liquid transfer roller 42, are formed to protrude in the printing paper widthwise direction Y on the both outer side surfaces of the circumferential wall 72 in the printing paper widthwise direction Y. Further, as shown in FIG. 4, a projection 76, which regulates the movement of the processing liquid accommodating cap 54 fixed to the upper surface, is formed at a central portion in the widthwise direction of the upper surface of the bottom plate section 70. The side surface of the projection 76, which is disposed on the upstream side in the rotating direction, is formed as such an inclined surface that upper portions thereof are more inclined toward the downstream side. In this embodiment, a hard material such as hard plastic or the like is used for the cap holder 56 so that the processing liquid accommodating cap 54 can be reliably held. However, the material of the cap holder 56 is not limited thereto. An absorbing member (not shown), which holds or retains the processing liquid R and the foreign matter Q scraped off by the upstream wall 62, may be arranged in the cap holder 56.

The processing liquid accommodating cap 54 is joined (for example, adhered) to the upper surface of the bottom plate section 70 positioned on the downstream side in the rotating direction with respect to the projection 76. Through-holes 78 (FIG. 3), which continuously penetrate through these components, are formed through the bottom plate section 58 of the processing liquid accommodating cap 54 and the bottom plate section 70 of the cap holder 56. As shown in FIG. 4, the opening 80 of the processing liquid accommodating cap 54 is arranged under or below the processing liquid transfer roller 42 in a state in which the processing liquid accommodating cap 54 is joined to the cap holder 56. The lowest point of the processing liquid transfer roller 42 is positioned within the width of the opening 80. The opening 80 is covered with the surface of the lower portion of the processing liquid transfer roller 42. The processing liquid R, which is fed from the processing liquid supply apparatus 48 (FIG. 1), is supplied from the through-hole 78 into the processing liquid accommodating cap 54. The processing liquid R is retained in the processing liquid accommodating cap 54. In this state, the open end of the cap holder 56 is positioned at a position lower than the upper end of the opening 80. Accordingly, the processing liquid accommodating cap 54 is reliably brought in contact with the surface of the processing liquid transfer roller 42.

Therefore, in this embodiment, the processing liquid R accommodated in the processing liquid accommodating cap 54 corresponds to the "processing liquid applying section" which applies the processing liquid R to the surface of the processing liquid transfer roller 42. The downstream wall 60 of the processing liquid accommodating cap 54 corresponds to the "downstream wall" which is positioned on the downstream side in the rotating direction with respect to the "contact point at which the processing liquid transfer roller makes a contact with the processing liquid in the processing liquid applying section". The upstream wall 62 of the processing liquid accommodating cap 54 corresponds to the "upstream wall" which is positioned on the upstream side in the rotating direction with respect to the "contact point at which the processing liquid transfer roller makes a contact with the processing liquid in the processing liquid applying section". The area, which is included in the internal space of the cap holder 56 and from which the area arranged with the processing liquid accommodating cap 54 is excluded, is the processing liquid recovery section S which recovers the processing liquid R and the foreign matter Q. Further, the applying member 44 is moved in a state in which the processing liquid accommodating cap 54 is brought in contact with the surface of the processing liquid transfer roller 42. In other words, the pressing force, which is transmitted from the processing liquid transfer roller 42 to the processing liquid accommodating cap 54 by the aid of the frictional force, acts as the "motive power" for moving the applying member 44 in the tangential direction at the lowermost position in the vertical direction of the processing liquid transfer roller 42 (hereinafter simply referred to as "tangential direction"), i.e., in the transport direction X. In this way, in this embodiment, the processing liquid transfer roller 42 functions as the "power source" for the moving mechanism G (FIGS. 2 and 7) described later on.

Figure 7:
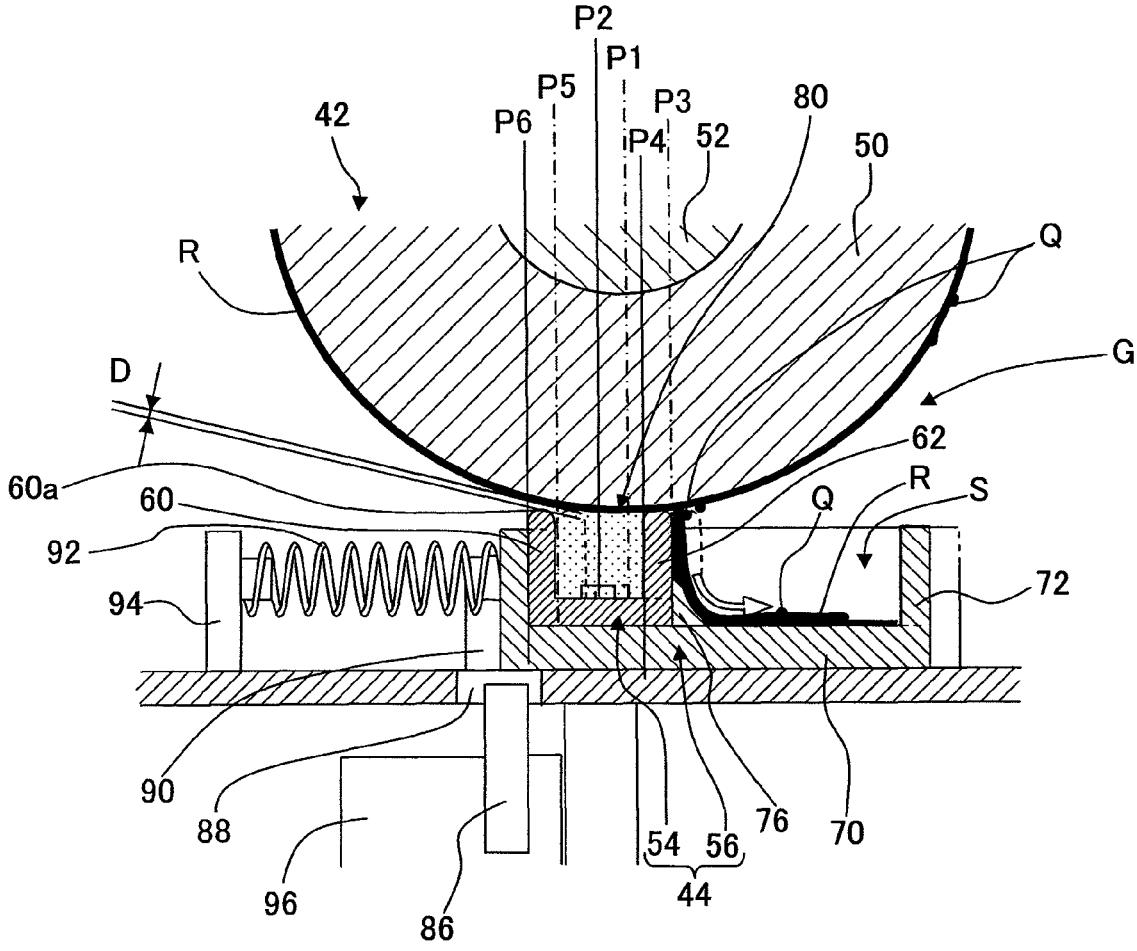
FIG. 7 shows a partial magnified sectional view illustrating the arrangement in the cleaning mode of the processing liquid applying apparatus according to the first embodiment.

As shown in FIG. 7, the applying member 44 as described above is arranged movably between the "transfer mode position P1" and the "cleaning mode position P2" under or below the processing liquid transfer roller 42. The "transfer mode position P1" herein means the position of the applying member 44 provided when the processing liquid R is transferred to the printing paper 12 as the "transfer medium". The "cleaning mode position P2" herein means the position of the applying member 44 provided when the remaining processing liquid and the foreign matter Q adhered to the surface of the processing liquid transfer roller 42 are washed out with the processing liquid R at the timing distinct from that of the "transfer mode". As shown in FIG. 7, the cleaning mode position P2 is positioned on the downstream side in the rotating direction as compared with the transfer mode position P1 on the basis of the central portion in the transport direction X of the bottom plate section 58 of the processing liquid accommodating cap 54.

As described above, the opening 80, which is the "processing liquid applying section", is arranged under or below the processing liquid transfer roller 42. The lowest point of the processing liquid transfer roller 42 is positioned within the width of the opening 80. Therefore, when the applying member 44 is moved toward the downstream side in the rotating direction in the tangential direction, the distance D between the forward end 60*a* on the upper side in the vertical direction of the downstream wall 60 and surface of the processing liquid transfer roller 42 (hereinafter simply referred to as "distance D between the downstream wall 60 and the processing liquid transfer roller 42) is increased. On the contrary, when the applying member 44 is moved toward the upstream side in the rotating direction in the tangential direction, the distance D between the downstream wall 60 and the processing liquid transfer roller 42 is decreased. When the applying member 44 is moved toward the downstream side in the rotating direction in the tangential direction, the contact pressure between the upstream wall 62 and the processing liquid transfer roller 42 is increased. On the contrary, when the applying member 44 is moved toward the upstream side in the rotating direction in the tangential direction, the contact pressure between the upstream wall 62 and the processing liquid transfer roller 42 is decreased.

Arrangement of Support Member

Figure 2:
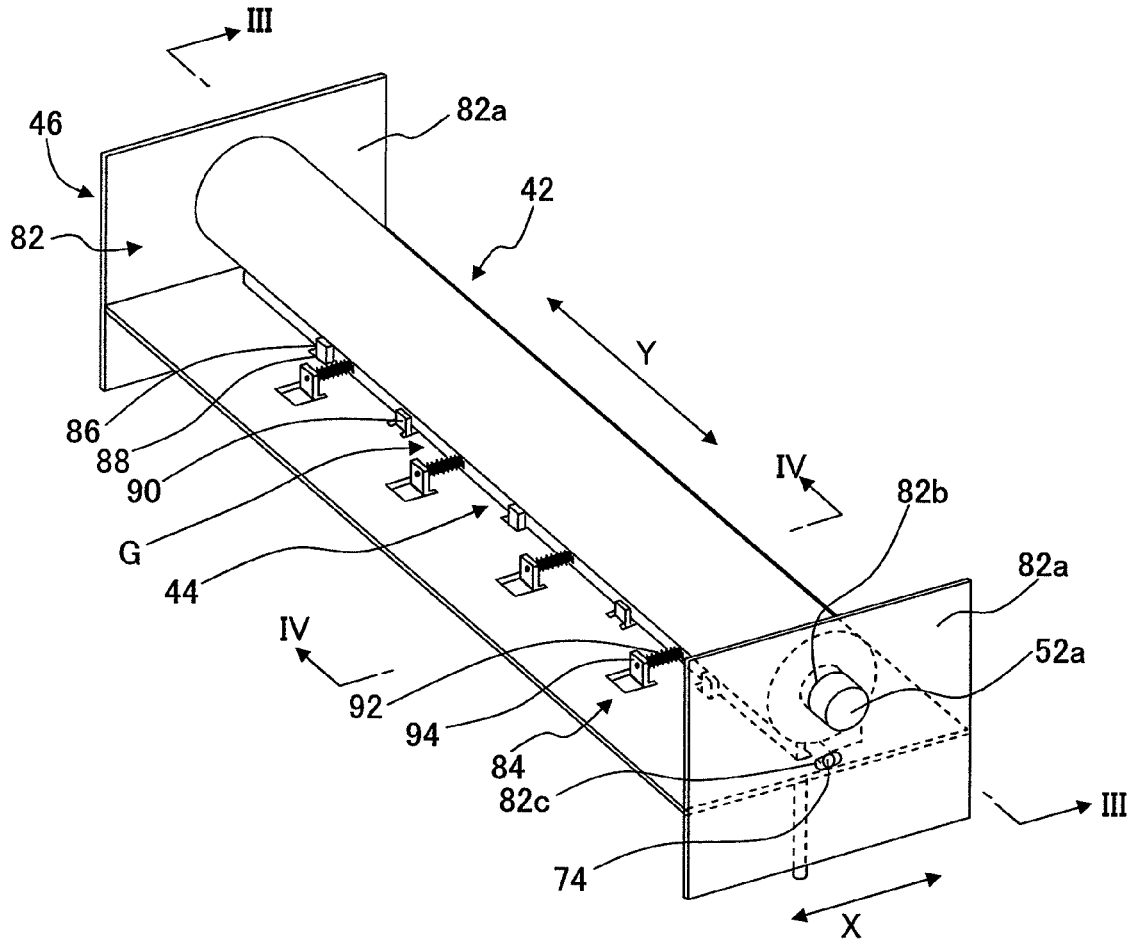
FIG. 2 shows a perspective view illustrating an arrangement of a processing liquid applying apparatus according to the first embodiment.

As shown in FIG. 2, the support member 46 has a bearing section 82 which rotatably supports the processing liquid transfer roller 42, and a sliding section 84 which slidably supports the applying member 44. The support member 46 supports the processing liquid transfer roller 42 and the applying member 44. Further, the support member 46 constitutes the moving mechanism G which moves the applying member 44 in cooperation with the processing liquid transfer roller 42.

As shown in FIG. 2, the bearing section 82 has two support plates 82*a* which are arranged in parallel to one another while being separated from each other by a spacing distance in the printing paper widthwise direction Y. As shown in FIG. 6, bearing holes 82*b*, which rotatably support the rotary shaft 52*a* of the processing liquid transfer roller 42, are formed mutually opposingly through the two support plates 82*a* respectively. Slotted holes 82*c*, which are long in the tangential direction and which support the projections 74 of the applying member 44 movably in the tangential direction of the processing liquid transfer roller 42, are formed mutually opposingly. The sliding section 84 is arranged somewhat under or below the slotted holes 82*c* between the two support plates 82*a*.

As shown in FIGS. 6 and 7, the sliding section 84 is a plate-shaped member which is substantially rectangular as viewed in a plan view and which extends in the printing paper widthwise direction Y. A central portion of the upper surface of the sliding section 84 in the tangential direction is a smooth surface 84*a* on which the applying member 44 is slidably placed. A plurality of (three in this embodiment) through-holes 88, into which transfer mode stoppers 86 are inserted in conformity with the arrangement position of the applying member 44, are formed while being separated from each other by spacing distances in the printing paper widthwise direction Y at the central portion of the sliding section 84 in the tangential direction. A plurality of (two in this embodiment) cleaning mode stoppers 90 are formed while being separated from each other by a spacing distance in the printing paper widthwise direction Y on the downstream side in the rotating direction as compared with the transfer mode stoppers 86. Further, a plurality of (four in this embodiment) support projections 94, which support coil springs 92, are formed while being separated from each other by spacing distances in the printing paper widthwise direction Y on the downstream side in the rotating direction as compared with the cleaning mode stoppers 90.

The transfer mode stoppers 86 are projections which position the applying member 44 at the "transfer mode position P1". The transfer mode stoppers 86 are moved upwardly and downwardly and they are moved in the tangential direction by the stopper driving apparatus 96 (FIG. 4) arranged under or below the sliding section 84. In other words, the transfer mode stoppers 86 are constructed so that the positions can be adjusted in the both directions of the "vertical direction" and the "tangential direction" by means of the stopper driving apparatus 96. The cleaning mode stoppers 90 are projections which position the applying member 44 at the "cleaning mode position P2". In this embodiment, the cleaning mode stoppers 90 are formed integrally with the sliding section 84. The coil springs 92 constitute the "restoring mechanism" which pushes and returns the applying member 44 positioned at the "cleaning mode position P2" toward the upstream side in the rotating direction as compared with the "transfer mode position P1". One end of the coil spring 92 is fixed to the support projection 94, and the other end is fixed to the applying member 44. The length of the coil spring 92 is designed so that the applying member 44 is positioned on the upstream side in the rotating direction as compared with the "transfer mode position P1" in the natural state. The cleaning mode stoppers 90 may be also constructed so that the positions can be adjusted in the "tangential direction" by means of a stopper driving apparatus (not shown).

In this embodiment, the coil spring 92 is used as the "restoring mechanism". However, the arrangement of the "restoring mechanism" is not specifically limited. For example, it is also allowable to use any other elastic member including, for example, plate spring, rubber, and elastomer. It is also allowable to use any driving apparatus including, for example, motor and electromagnetic solenoid. It is also allowable to use any arrangement in which the restoration is effected manually. Further, the applying member 44 may be allowed to function as the "restoring mechanism" by forming a part or all of the applying member 44 with an elastic material including, for example, rubber and elastomer. However, when the "restoring mechanism" has an urging means for urging the applying member 44 toward the upstream side in the rotating direction, it is desirable to provide such a design that the frictional force, which is generated between the processing liquid accommodating cap 54 and the processing liquid transfer roller 42, is greater than the urging force of the "restoring mechanism" to be exerted on the applying member 44 in order to move the applying member 44 to the "transfer mode position P1".

Arrangement of Processing Liquid Supply Apparatus

As shown in FIG. 1, the processing liquid supply apparatus 48 includes a tank 100 which stores the processing liquid R, a supply tube 102*a* which connects the tank 100 and one of the through-holes 78, a recovery tube 102*b* which connects the tank 100 and the other through-hole 78, and a pump 104 which is arranged at an intermediate position of the recovery tube and which sucks or pressurizes the processing liquid R contained in the processing liquid accommodating cap 54. The liquid amount of the processing liquid R in the processing liquid accommodating cap 54 is properly retained by circulating the processing liquid R by means of the pump 104.

Operation of Image-Forming Apparatus

When the image is formed on the printing paper 12 by using the image-forming apparatus 10, the image signal is inputted into the control unit 26 from the external device such as a personal computer or the like. Accordingly, the control unit 26 drives the transport apparatus 20. The printing paper 12, which is accommodated in the paper feed cassette 16, is taken out by the pickup roller 30, and the printing paper 12 is fed to the processing liquid applying apparatus 22 via the detecting unit 24. The detecting unit 24 detects the type (for example, thickness, surface smoothness, and hardness) of the printing paper 12 transported through the transport route M, and the detection result is given to the control unit 26.

Transfer Mode

When the processing liquid applying apparatus 22 is operated in the "transfer mode", the transfer mode stoppers 86 are moved upwardly by the stopper driving apparatus 96 in the state in which the applying member 44 is positioned on the upstream side in the rotating direction as compared with the through-holes 88 of the sliding section 84, and the transfer mode stoppers 86 are allowed to protrude from the upper surface of the sliding section 84. In the state in which the applying member 44 is positioned on the upstream side in the rotating direction as compared with the through-holes 88, the lengths of the coil springs 92 are in the natural state, and the urging force is not generated in the coil springs 92 which press the applying member 44 toward the upstream side in the rotating direction. Therefore, when the processing liquid transfer roller 42 is thereafter driven and rotated, the pressing force, which is directed toward the downstream side in the rotating direction in the tangential direction, is applied by the aid of the frictional force to the upstream wall 62 from the surface of the processing liquid transfer roller 42. The pressing force is greater than the urging force of the coil springs 92. Therefore, the entire applying member 44 is moved toward the downstream side in the rotating direction in the tangential direction, and the fastening surface 72*a* of the applying member 44 is allowed to abut against the transfer mode stoppers 86. In other words, the applying member 44 is positioned at the "transfer mode position P1" by means of the transfer mode stoppers 86.

When the applying amount of the processing liquid R is adjusted depending on the type of the printing paper 12, the stopper driving apparatus 96 is controlled by the control unit 26 which serves as the "stopper control unit" based on the detection result obtained by the detecting unit 24. The transfer mode stoppers 86 are moved in the tangential direction. In other words, the "transfer mode position P1" is positionally adjusted in the tangential direction so that the preferred applying amount is obtained depending on the type of the printing paper 12. For example, if the control unit 26 judges that "the liquid absorption performance of the printing paper 12 is high" based on the detection result obtained by the detecting unit 24, it is necessary that the applying amount of the processing liquid R with respect to the processing liquid transfer roller 42 should be increased. In this case, the transfer mode stoppers 86 are moved toward the downstream side in the rotating direction, and thus the "transfer mode position P1" is moved toward the downstream side in the rotating direction. The distance D between the downstream wall 60 and the processing liquid transfer roller 42 is increased. In the "transfer mode", the applying member 44 is positioned by the transfer mode stoppers 86. Therefore, the distance D between the downstream wall 60 and the processing liquid transfer roller 42 is stable at a constant distance. The applying amount of the processing liquid R with respect to the surface of the processing liquid transfer roller 42 is not undesirably varied or fluctuated. In other words, the downstream wall 60 functions as the "applying amount adjusting member" which adjusts the applying amount of the processing liquid R.

The processing liquid R, which has been applied to the surface of the processing liquid transfer roller 42 from the applying member 44, is transferred to the surface of the printing paper 12 brought in contact with the surface of the processing liquid transfer roller 42. The printing paper 12, to which the processing liquid R has been transferred, is fed to the liquid discharge apparatus 18. The image is formed on the surface of the printing paper 12, and then the printing paper 12 is discharged from the printing paper discharge port 14*b* by means of the paper discharge rollers 36. The processing liquid R, which remains on the surface of the processing liquid transfer roller 42, is scraped off toward the outer side surface of the upstream wall 62 by means of the upstream wall 62 upon the contact with the upstream wall 62. In other words, the upstream wall 62 functions as the "cleaning member" which scrapes the foreign matter Q and the processing liquid R remained on the surface of the processing liquid applying roller 42. Also in the "transfer mode", the foreign matter Q, which is removed by the upstream wall 62, may be washed out with the processing liquid R by feeding the processing liquid R to the upstream wall 62 without transferring the processing liquid R to the printing paper 12 in the same manner as in the "cleaning mode" described below.

Cleaning Mode

For example, when the printing operation is not performed for a long period of time, then the remaining processing liquid R is deposited on the surface of the processing liquid transfer roller 42 in some cases, and the viscosity of the remaining processing liquid R is increased, resulting in the adhesion to the surface of the processing liquid transfer roller 42 together with the foreign matter Q or the like in other cases. When the printing operation is repeatedly performed in the "transfer mode", then the remaining processing liquid R or the foreign matter Q (hereinafter referred to as "foreign matter Q or the like") are adhered and accumulated on the surface of the processing liquid transfer roller 42 and the outer side surface of the upstream wall 62, the foreign matter Q or the like is interposed and accumulated between the upstream wall 62 and the processing liquid transfer roller 42, and/or the foreign matter Q or the like enters the interior of the processing liquid accommodating cap 54 in some cases. If the transfer operation is continued without removing the foreign matter Q or the like in such situations, the performance of the processing liquid applying apparatus 22 is conspicuously deteriorated, because any new processing liquid R is not transferred to the portion of the surface of the processing liquid transfer roller 42 to which the foreign matter Q or the like is adhered. When any gap appears between the upstream wall 62 and the processing liquid transfer roller 42 due to the foreign matter Q or the like interposed between the upstream wall 62 and the processing liquid transfer roller 42, it is feared that the air may enter the interior of the processing liquid accommodating cap 54 due to the negative pressure for sucking the processing liquid R, and/or the processing liquid R contained in the processing liquid accommodating cap 54 may leak to the outside due to the positive pressure for supplying the processing liquid R into the processing liquid accommodating cap 54. Further, when the foreign matter Q or the like enters the interior of the processing liquid accommodating cap 54, it is feared that any "uneven application or coating" of the processing liquid R may be caused in the step of applying the processing liquid R to the surface of the processing liquid transfer roller 42.

In view of the above, in order to remove the foreign matter Q or the like, for example, from the processing liquid transfer roller 42, the user starts the "cleaning mode", for example, by operating a mode selection switch. In the "cleaning mode", the transfer mode stoppers 86 are moved downwardly by means of the stopper driving apparatus 96, and the transfer mode stoppers 86 are retracted downwardly from the upper surface of the sliding section 84. Therefore, when the processing liquid transfer roller 42 is driven and rotated, then the upstream wall 62 is pressed toward the downstream side in the rotating direction in the tangential direction by the surface of the processing liquid transfer roller 42, and thus the entire applying member 44 is moved toward the downstream side in the rotating direction. The fastening surface 72*a* of the applying member 44 is allowed to abut against the cleaning mode stoppers 90. In other words, the applying member 44 is positioned at the "cleaning mode position P2" by means of the cleaning mode stoppers 90. When the process proceeds from the cleaning mode to the transfer mode again, the rotation of the processing liquid transfer roller 42 is stopped. When the rotation of the processing liquid transfer roller 42 is stopped, the pressing force, which is exerted from the surface of the processing liquid transfer roller 42, is not exerted on the upstream wall 62. Therefore, the coil springs 92, which have been compressed, are restored to the natural state. Accordingly, the applying member 44 is moved to the upstream side in the rotating direction as compared with the through-holes 88 of the sliding section 84. In this state, the transfer mode stoppers 86 are allowed to protrude from the upper surface of the sliding section 84 again, and the processing liquid transfer roller 42 is rotated. Accordingly, the transfer mode is started.

In this embodiment, the upstream wall 62 is formed integrally with the applying member 44. Therefore, the upstream wall 62 is also moved in accordance with the movement of the applying member 44. It is assumed that the position of the upstream wall 62 is referred to as "upstream wall first position P3" when the applying member 44 is positioned at the "transfer mode position P1". It is assumed that the position of the upstream wall 62 is referred to as "upstream wall second position P4" when the applying member 44 is positioned at the "cleaning mode position P2". On this assumption, the contact pressure between the upstream wall 62 and the processing liquid transfer roller 42 is great when the upstream wall 62 is positioned at the "upstream wall second position P4" as compared with when the upstream wall 62 is positioned at the "upstream wall first position P3". Therefore, the force, with which the foreign matter Q adhered to the surface of the processing liquid transfer roller 42 is scraped off, is increased in the "cleaning mode", i.e., when "the upstream wall 62 is at the upstream wall second position P4" as compared with the "transfer mode", i.e., when "the upstream wall 62 is positioned at the upstream wall first position P3".

In this embodiment, the downstream wall 60 is formed integrally with the applying member 44. Therefore, the downstream wall 60 is also moved in accordance with the movement of the applying member 44. It is assumed that the position of the downstream wall 60 is referred to as "downstream wall first position P5" when the applying member 44 is positioned at the "transfer mode position P1". It is assumed that the position of the downstream wall 60 is referred to as "downstream wall second position P6" when the applying member 44 is positioned at the "cleaning mode position P2". On this assumption, as shown in FIG. 7, the distance D between the downstream wall 60 and the processing liquid transfer roller 42 is increased when the downstream wall 60 is positioned at the "downstream wall second position P6" as compared with when the downstream wall 60 is positioned at the "downstream wall first position P5". Therefore, the applying amount of the processing liquid R with respect to the surface of the processing liquid transfer roller 42 is increased in the "cleaning mode", i.e., when "the downstream wall 60 is positioned at the downstream wall second position P6" as compared with the "transfer mode", i.e., when "the downstream wall 60 is positioned at the downstream wall first position P5".

Therefore, in the "cleaning mode", the foreign matter Q or the like can be efficiently scraped off owing to the large contact pressure of the upstream wall 62 with respect to the processing liquid transfer roller 42, and it is possible to effectively prevent the foreign matter Q or the like from entering the space between the upstream wall 62 and the processing liquid transfer roller 42. Further, the foreign matter Q or the like, which has been scraped off by the upstream wall 62, can be efficiently washed out with the large amount of the processing liquid R. The grooves 62*a*, which guide the foreign matter Q or the like to the processing liquid recovery section S, are formed on the outer side surface of the upstream wall 62, and the water-attracting treatment is applied. Therefore, the foreign matter Q or the like can be efficiently washed out with the processing liquid R, and the foreign matter Q or the like can be recovered by the processing liquid recovery section S. Further, when the cleaning mode stoppers 90 are also constructed so that the cleaning mode stoppers 90 can be positionally adjusted in the "tangential direction" by means of the stopper driving apparatus (not shown), the applying member 44 can be positioned at the position appropriate to remove the foreign matter Q or the like depending on the type of the foreign matter Q or the like.

In this embodiment, the "moving mechanism G", which moves the applying member 44 between the "transfer mode position P1" and the "cleaning mode position P2", is constructed by the processing liquid transfer roller 42, the support member 46, the coil springs 92, the transfer mode stoppers 86, and the cleaning mode stoppers 90. The downstream wall 60 and the upstream wall 62 are formed integrally with the applying member 44 (processing liquid accommodating cap 54). Therefore, "the operation for adjusting the applying amount of the processing liquid R with respect to the processing liquid transfer roller 42" and "the operation for adjusting the force (contact pressure) to scrape off the foreign matter Q or the like" can be simultaneously performed by means of the "moving mechanism G". The operations can be performed easily and quickly.

Second Embodiment

Figure 8:
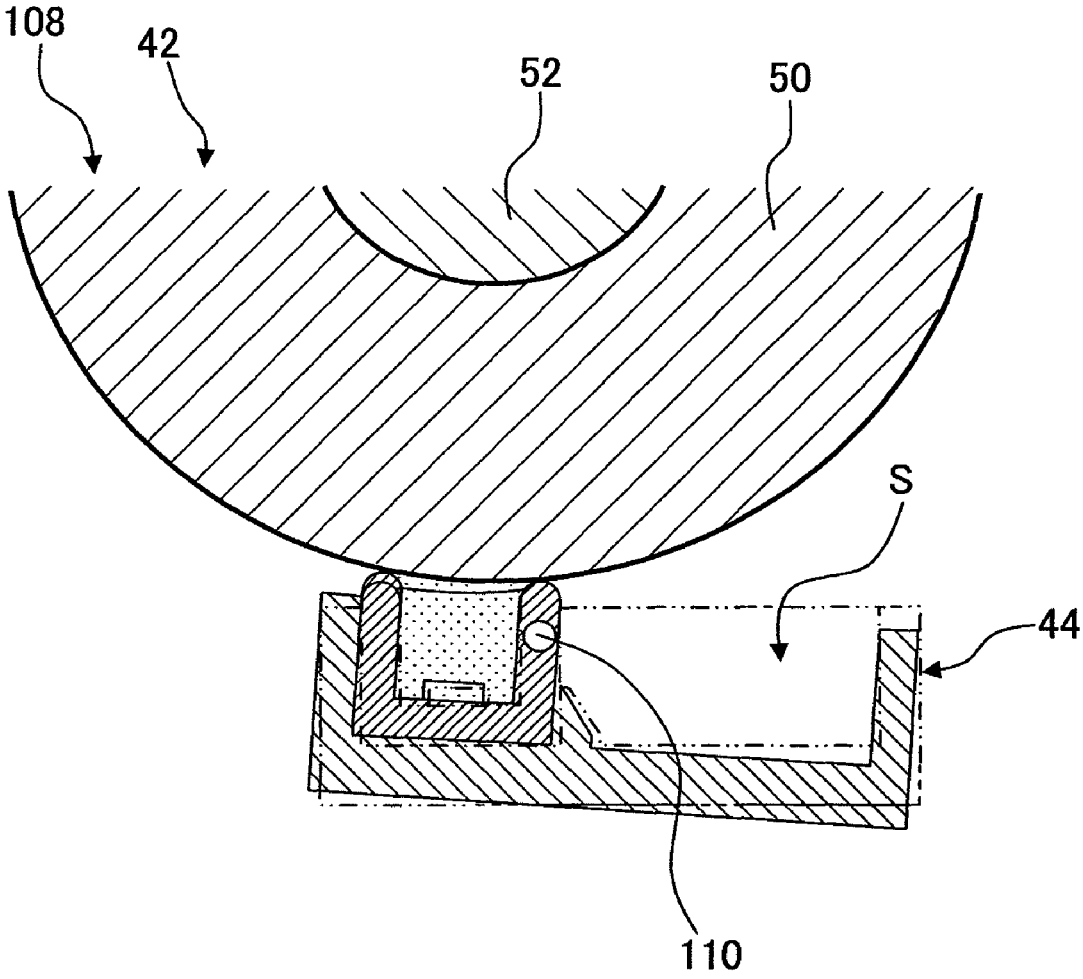
FIG. 8 shows a partial magnified sectional view illustrating an arrangement of a processing liquid applying apparatus according to a second embodiment.

In a processing liquid applying apparatus 108 according to a second embodiment, as shown in FIG. 8, rotary shafts 110 of a applying member 44 are formed at both end portions in the printing paper widthwise direction Y of the applying member 44, and a motor (not shown) is connected to the rotary shaft 110. The angle of rotation of the motor is controlled by the control unit 26, and thus the "transfer mode (solid lines shown in FIG. 8)" and the "cleaning mode (two-dot chain lines shown in FIG. 8)" are switched. In other words, the distance D between the downstream wall 60 and the processing liquid transfer roller 42 in the "cleaning mode" is greater than the distance D in the "transfer mode". Further, the contact pressure of the upstream wall 62 with respect to the processing liquid transfer roller 42 in the "cleaning mode" is smaller than the contact pressure in the "transfer mode". In this way, in the second embodiment, it is possible to more finely adjust the "distance" D between the downstream wall 60 and the processing liquid transfer roller 42 and the "contact pressure" between the upstream wall 62 and the processing liquid transfer roller 42 merely by controlling the angle of rotation of the motor.

Third Embodiment

Figure 9:
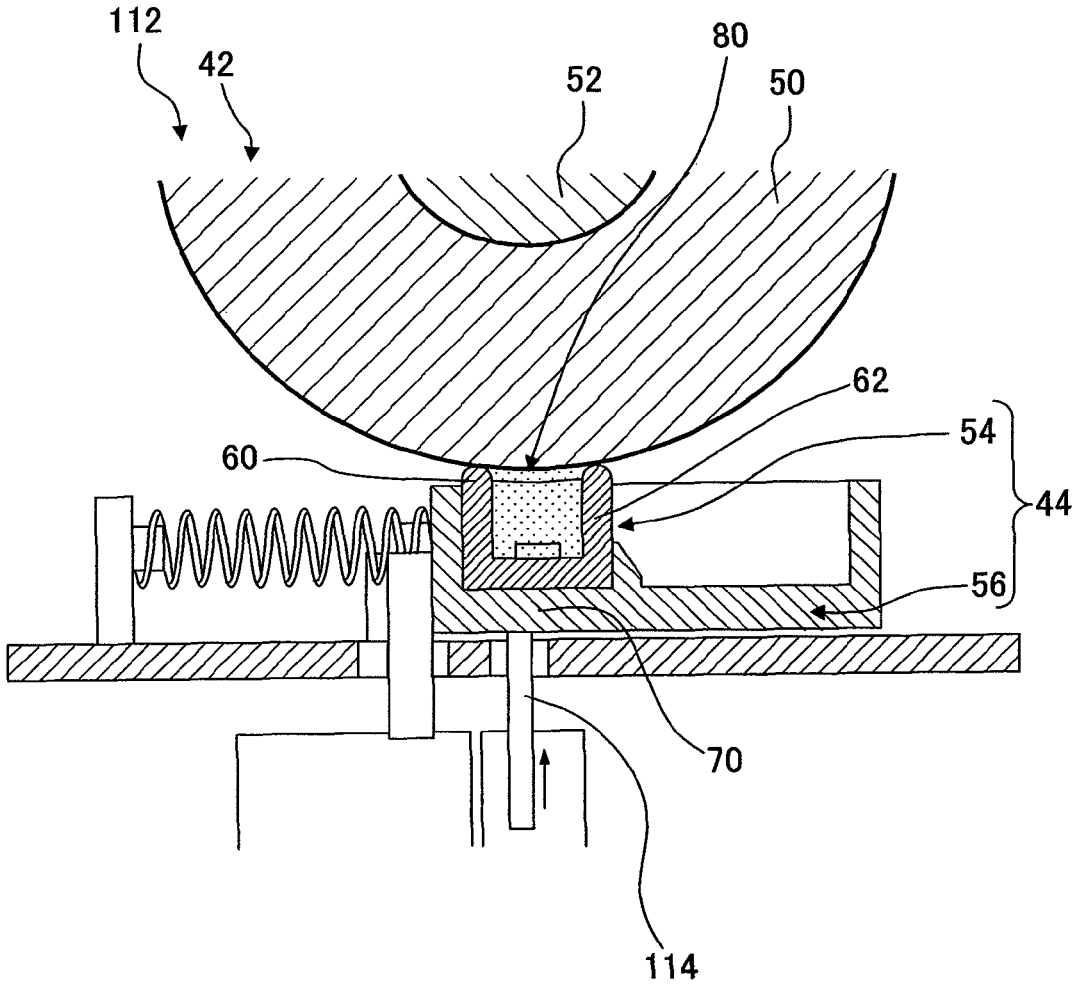
FIG. 9 shows a partial magnified sectional view illustrating an arrangement of a processing liquid applying apparatus according to a third embodiment.

In a processing liquid applying apparatus 112 according to a third embodiment, as shown in FIG. 9, a pressing member 114, which includes, for example, an electromagnetic solenoid or an air cylinder and which presses the applying member 44 toward the side of the processing liquid transfer roller 42, is arranged under or below the applying member 44. In the "waiting state" in which the drying and the increase in viscosity of the processing liquid R accommodated in the processing liquid accommodating cap 54 is avoided to preferably maintain the viscosity of the processing liquid R when the printing operation of the image-forming apparatus 10 is not performed, the applying member 44 is pressed by the pressing member 114. Accordingly, the forward ends of the respective walls 60, 62, 64 of the applying member 44 are allowed to abut against the surface of the processing liquid transfer roller 42 in a capping state in a liquid-tight manner. Therefore, in the "waiting state", it is possible to prevent the processing liquid R contained in the processing liquid accommodating cap 54 from any contact with the external air or the outside air, it is possible to avoid the drying and the increase in viscosity of the processing liquid R, and it is possible to always preferably maintain the viscosity of the processing liquid R. Even when the processing liquid transfer roller 42 is rotated in the "waiting state", it is possible to avoid the leakage of the processing liquid R from the processing liquid accommodating cap 54.

The position of arrangement in the tangential direction of the applying member 44 in the "waiting state" is not specifically limited. However, in order to allow the forward ends of the respective walls 60, 62, 64 to reliably abut against the surface of the processing liquid transfer roller 42, it is desirable that the position of arrangement in the tangential direction of the applying member 44 in the "waiting state" is slightly deviated toward the upstream side in the rotating direction as compared with the "transfer mode position P1". When the downstream wall 60 and the upstream wall 62 have the same height, it is desirable that the lowest point of the processing liquid transfer roller 42 is positioned at the center in the widthwise direction (tangential direction) of the opening 80 in order to obtain the equivalent contact pressure in relation to the processing liquid transfer roller 42, the downstream wall 60, and the upstream wall 62 in the "waiting state".

Other Embodiments

In the respective embodiments described above, the downstream wall 60 and the upstream wall 62, which constitute the processing liquid accommodating cap 54, are formed integrally. Therefore, the "downstream wall moving mechanism" which moves the downstream wall 60 between the "downstream wall first position" and the "downstream wall second position" and the "upstream wall moving mechanism" which moves the upstream wall 62 between the "upstream wall first position" and the "upstream wall second position" are unified into one "moving mechanism G". However, the downstream wall 60 and the upstream wall 62 may be moved distinctly by distinctly forming the downstream wall 60 and the upstream wall 62.

In the respective embodiments described above, the processing liquid R is accommodated in the processing liquid accommodating cap 54. However, for example, a porous member such as sponge or urethane, in which the processing liquid R is absorbed, may be accommodated in the processing liquid accommodating cap 54. In this case, the porous member and the processing liquid R absorbed in the porous member correspond to the "processing liquid applying section".

In the respective embodiments described above, the present invention is applied to the "ink-jet printer". However, the present invention is also applicable to any "image-forming apparatus" of another type including, for example, the "facsimile" and the "multifunction machine". Further, the present invention is also applicable to any recording system including, for example, the "thermal transfer system", the "electronic photograph system", and the "silver salt photograph system" in addition to the "ink-jet system".

In the respective embodiments described above, the "processing liquid transfer" is performed by the processing liquid applying apparatus 22 before the "image formation" by the liquid discharge apparatus 18. However, the "processing liquid transfer" may be performed after the "image formation", or the "processing liquid transfer" may be performed both before and after the "image formation".

In the respective embodiments described above, the printing paper 12 is used as the "transfer medium". However, the type of the "transfer medium" is not specifically limited. For example, when a transmission type manuscript is prepared, it is also allowable to use a plastic sheet composed of polyethylene terephthalate or the like.

What is claimed is:

1. A processing liquid applying apparatus which applies a processing liquid to a transfer medium, the apparatus comprising:

a processing liquid transfer roller which transfers the processing liquid to the transfer medium while rotating in a predetermined direction;

a processing liquid applying section which makes a contact with a surface of the processing liquid transfer roller to apply the processing liquid to the surface of the processing liquid transfer roller;

a downstream wall which is positioned on a downstream side in a rotating direction of the processing liquid transfer roller with respect to a contact point at which the surface of the processing liquid transfer roller makes a contact with the processing liquid in the processing liquid applying section; and a downstream wall moving mechanism which moves the downstream wall, in a tangential direction at the contact point of the processing liquid applying section and the processing liquid transfer roller, between a downstream wall first position at which the downstream wall is positioned while the processing liquid transfer roller is transferring the processing liquid to the transfer medium and a downstream wall second position at which the downstream wall is positioned while the surface of the processing liquid transfer roller is being washed with the processing liquid, wherein a distance between the downstream wall positioned at the downstream wall second position and the processing liquid transfer roller, is greater than a distance between the downstream wall positioned at the downstream wall first position and the processing liquid transfer roller.

2. The processing liquid applying apparatus according to claim 1, further comprising:

an upstream wall which is positioned on an upstream side in the rotating direction of the processing liquid transfer roller with respect to the processing liquid applying section; and an upstream wall moving mechanism which moves the upstream wall, in a tangential direction between an upstream wall first position at which the upstream wall is positioned while the processing liquid transfer roller is transferring the processing liquid to the transfer medium and an upstream wall second position at which the upstream wall is positioned while the surface of the processing liquid transfer roller is being washed with the processing liquid, wherein a contact pressure between the upstream wall positioned at the upstream wall second position and the processing liquid transfer roller, is greater than a contact pressure between the upstream wall positioned at the upstream wall first position and the processing liquid transfer roller.

3. The processing liquid applying apparatus according to claim 2, wherein the downstream wall and the upstream wall are formed integrally so that a relative positional relationship between the downstream wall and the upstream wall is not varied.

4. The processing liquid applying apparatus according to claim 3, wherein: each of the downstream wall and the upstream wall is formed as a part of a processing liquid accommodating cap which is arranged to extend in an axial direction of the processing liquid transfer roller, which has an opening covered with the surface of the processing liquid transfer roller, and which accommodates the processing liquid therein;

the processing liquid applying section is the processing liquid accommodated in the processing liquid accommodating cap;

the downstream wall is one side wall of the processing liquid accommodating cap; and the upstream wall is a side wall opposed to the one side wall of the processing liquid accommodating cap.

5. The processing liquid applying apparatus according to claim 3, wherein the downstream wall moving mechanism moves the downstream wall integrated with the upstream wall from the downstream wall first position to the downstream wall second position by pressing the upstream wall with the surface of the processing liquid transfer roller rotated in the predetermined direction.

6. The processing liquid applying apparatus according to claim 5, wherein the downstream wall moving mechanism has a transfer mode stopper which positions the downstream wall at the downstream wall first position, a cleaning mode stopper which positions the downstream wall at the downstream wall second position, and a restoring mechanism which restores the downstream wall from the downstream wall second position to the downstream wall first position.

7. The processing liquid applying apparatus according to claim 6, wherein at least one of the transfer mode stopper and the cleaning mode stopper is movable in the tangential direction.

8. The processing liquid applying apparatus according to claim 7, wherein the downstream wall moving mechanism has a detecting unit which detects a type of the transfer medium, a stopper driving apparatus which moves at least one of the transfer mode stopper and the cleaning mode stopper, and a stopper control unit which controls the stopper driving apparatus based on an output of the detecting unit.

9. The processing liquid applying apparatus according to claim 4, further comprising a processing liquid recovery section which is provided on the upstream side in the rotating direction of the processing liquid transfer roller with respect to the upstream wall and which recovers the processing liquid scraped off from the surface of the processing liquid transfer roller by the upstream wall.

10. The processing liquid applying apparatus according to claim 9, wherein a groove, which guides the processing liquid scraped off from the surface of the processing liquid transfer roller by the upstream wall, is formed on a surface of the upstream wall positioned on the upstream side in the rotating direction of the processing liquid transfer roller.

11. An image-forming apparatus comprising:

a liquid discharge apparatus which forms an image on a surface of a transfer medium by discharging a liquid to the transfer medium;

a transport apparatus which transports the transfer medium to the liquid discharge apparatus; and the processing liquid applying apparatus as defined in claim 1 which is arranged on at least one of an upstream side in a transport direction or a downstream side in the transport direction of the transfer medium with respect to the liquid discharge apparatus.

12. The image-forming apparatus according to claim 11, further comprising a controller which controls the downstream wall moving mechanism to move the downstream wall between the downstream wall first position and the downstream wall second position.

13. The image-forming apparatus according to claim 12, further comprising a detector which detects a type of the transfer medium, wherein the controller controls the downstream wall moving mechanism based on the detection result of the detector.

* * * * *